US008146268B2

(12) United States Patent
Farina et al.

(10) Patent No.: US 8,146,268 B2
(45) Date of Patent: Apr. 3, 2012

(54) SHOE HAVING AN AIR CUSHIONING SYSTEM

(75) Inventors: Salvo Farina, Brooklyn, NY (US); Steve Weston, New Canaan, CT (US)

(73) Assignee: Sears Brands, LLC, Hoffman Estates, IL (US)

( * ) Notice: Subject to any disclaimer, the term of this patent is extended or adjusted under 35 U.S.C. 154(b) by 568 days.

(21) Appl. No.: 12/360,879

(22) Filed: Jan. 28, 2009

(65) Prior Publication Data

US 2010/0186256 A1 Jul. 29, 2010

(51) Int. Cl.
*A43B 7/06* (2006.01)

(52) U.S. Cl. ..... 36/3 R; 36/3 B; 36/35 B

(58) Field of Classification Search ..... 36/3 R, 36/3 B, 29, 35 B
See application file for complete search history.

(56) References Cited

U.S. PATENT DOCUMENTS 1,649,236 A * 11/1927 Jurcsak ..... 36/3 R
3,027,659 A * 4/1962 Gianola ..... 36/3 R
3,128,566 A * 4/1964 Burlison et al. ..... 36/3 R
4,845,863 A 7/1989 Yung-Mao
5,084,987 A 2/1992 Flemming
5,163,198 A 11/1992 Herber
5,430,960 A 7/1995 Richardson
5,477,626 A * 12/1995 Kwon ..... 36/3 B
5,577,334 A 11/1996 Park
5,655,314 A 8/1997 Petracci
5,930,919 A 8/1999 Mathias
5,953,835 A 9/1999 Kwon
5,974,694 A 11/1999 Vecchiola
5,996,253 A 12/1999 Spector
6,128,837 A 10/2000 Huang
6,189,241 B1 2/2001 Liu
6,311,413 B1 11/2001 Chern
6,370,800 B1 * 4/2002 Hung ..... 36/3 B
6,415,529 B1 * 7/2002 Kelley ..... 36/3 R
6,553,691 B2 4/2003 Huang
6,591,519 B1 7/2003 Ellis, III
6,751,890 B1 6/2004 Tsai
6,878,125 B1 4/2005 Bentivegna
6,915,594 B2 7/2005 Kim
6,948,260 B2 9/2005 Lin
6,966,129 B2 11/2005 Meschan
D512,555 S 12/2005 Tseng
7,013,585 B2 3/2006 Lo
7,043,857 B2 5/2006 Meschan
7,051,456 B2 * 5/2006 Swigart et al. ..... 36/3 R
7,171,765 B2 2/2007 Lo
7,380,350 B2 6/2008 Meschan
7,395,615 B2 * 7/2008 Lee ..... 36/29
7,409,779 B2 * 8/2008 Dojan et al. ..... 36/3 B
2001/0045026 A1 11/2001 Huang
2002/0040538 A1 4/2002 Kim
2002/0144426 A1 10/2002 Chen
2004/0154191 A1 8/2004 Park
2004/0194343 A1 10/2004 Kim
2004/0221481 A1 * 11/2004 Regen ..... 36/3 B
2005/0005473 A1 1/2005 Oh
2005/0022424 A1 2/2005 Held (Continued)

*Primary Examiner* — Marie Patterson
(74) *Attorney, Agent, or Firm* — Greenberg Traurig LLP

(57) ABSTRACT

An air cushioning system for use in a shoe has a molded heel absorber member the includes a center member that forms a sealed center air chamber and a peripheral member that extends about at least a portion of the periphery of the center member and that forms a vented peripheral air chamber. A vented air conduit is in communication with the vented peripheral air chamber.

22 Claims, 1 Drawing Sheet

U.S. PATENT DOCUMENTS

2005/0138838 A1 6/2005 Lin
2005/0229432 A1 10/2005 Lo
2006/0032089 A1 2/2006 Lo
2006/0086003 A1 4/2006 Tseng
2007/0056188 A1 3/2007 Tsai
2007/0089319 A1* 4/2007 Liao et al. ..... 36/3 R
2007/0094890 A1 5/2007 Cho et al.
2007/0094891 A1* 5/2007 Myslinski ..... 36/3 R
2008/0163517 A1* 7/2008 Chen ..... 36/3 B
2008/0184600 A1 8/2008 Yang
2008/0229623 A1* 9/2008 Ferretti ..... 36/3 B

* cited by examiner

SHOE HAVING AN AIR CUSHIONING SYSTEM

BACKGROUND

In the art, air cushioning systems for shoes are generally known. For example, U.S. Pat. No. 7,395,615 discloses a pumping device for use in a shoe that includes a cushion body formed inside a sole of the shoe. The cushion body includes front and back air chambers disposed in the front and heel of the shoe, respectively. A pump is mounted adjacent to and in communication with the back air chamber and a suction valve and a check valve are mounted at the front and back sides of the pump to provide air to the back air chamber. A pressure adjusting valve provides a connection between the back air chamber and the front air chamber.

A further example of an air cushioning system is disclosed in U.S. Published Application No. 2005/0005473 which describes a shoe insert that functions to form a pumping chamber. Connected to the pumping chamber is an air inlet conduit as well as an air outlet check valve that leads to an air outlet conduit. When the pumping chamber is in a pumping mode during use, air is brought into the shoe from the outside via the air inlet conduit and circulated through the midsole and toe region of the shoe via the air outlet conduit.

Yet further, U.S. Publication No. 2007/0294916 discloses an air cushioning and circulation system for a shoe. The shoe is provided with first and second air rooms that are formed in the front and rear of the shoe, respectively. The first and second air rooms communicate with each other through passages. A plurality of sucking holes are formed in the inner sole layer to communicate air to throughholes provided to the first air room. First and second buffering members are incorporated in the first and second air rooms, respectively, to alleviate shock and circulate the air. In addition, a first check valve is disposed in the front of the second air room to open and close the passages and a second check valve is disposed in the rear of the second air room to communicate with the outside so as to discharge the air.

Each of these publications is incorporated herein by reference in its entirety.

SUMMARY

A novel air cushioning system for a shoe is hereinafter described. Generally, the air cushioning system has a molded heel absorber member the includes a center member that forms a sealed center air chamber and a peripheral member that extends about at least a portion of the periphery of the center member and that forms a vented peripheral air chamber. A vented air conduit is in communication with the vented peripheral air chamber.

A better understanding of the objects, advantages, features, properties and relationships of the novel air cushioning system will be obtained from the following detailed description and accompanying drawings which set forth an illustrative, preferred embodiment indicative of the various ways in which the principles of the invention may be employed.

BRIEF DESCRIPTION OF THE DRAWINGS

For a better understanding of the air cushioning system described hereinafter reference may be had to the following drawings in which.

DETAILED DESCRIPTION

Figure 1:
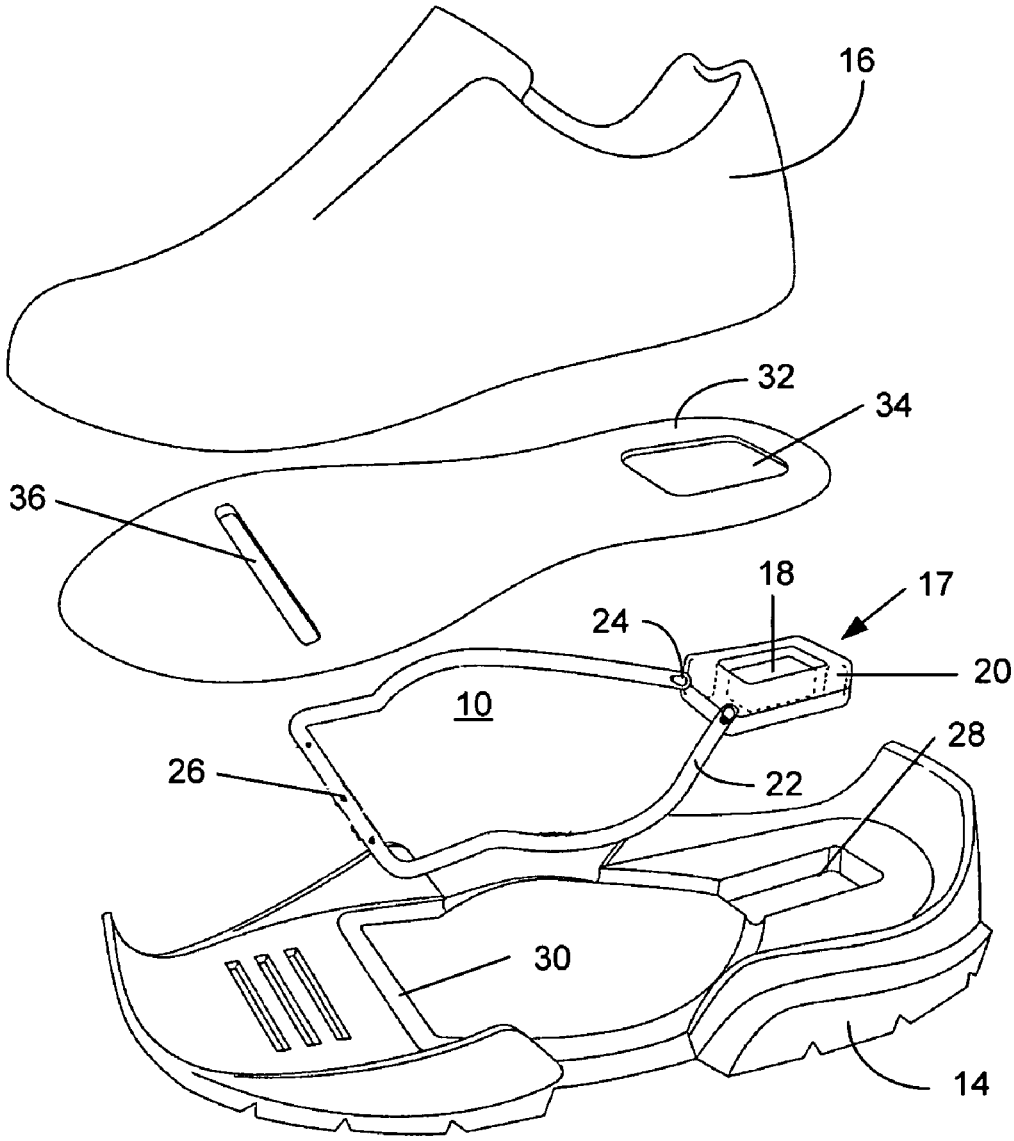
FIG. 1 is an exploded view of a shoe showing an exemplary air cushioning system constructed in accordance with the invention claimed.

Referring now to the figures, a novel air cushioning system 10 for use in connection with a shoe is hereinafter described. As will be appreciated by those of ordinary skill in the art, the shoe includes an outsole/midsole unit 14 to which is attached a shoe upper 16. As illustrated in FIG. 1, the air cushioning system 10 is disposed intermediate the outsole/midsole unit 14 and the shoe upper 16.

Considering the air cushioning system 10, the air cushioning system 10 generally includes a heal chamber absorber member 17 that is comprised of a center air chamber 18 and a peripheral decompression chamber 20. The heal chamber absorber member 17 may be molded using polyvinyl chloride (PVC), thermal plastic urethane, or the like type of materials. By way of example, an upper half and a lower half the heal chamber absorber member 17 may be separately molded and joined together at their edges using a conventional heat sealing process. Once constructed, the center air chamber 18 of the heal chamber absorber member 17 will be entirely sealed about its periphery and, as such, air that is trapped in the center air chamber 18 during construction of the heal chamber absorber member will not be vented upon compression of the center air chamber 18 during use of the shoe. The walls of the center air chamber 18 are provided with a thickness that allows the center air chamber 18 to deform and compress the air trapped therein while preventing any rupturing of the center air chamber 18 during use of the shoe. An exemplary thickness is at least 1 mm. While illustrated in the form of a single air holding chamber 18*a*, it is to be appreciated that the center air chamber 18 can include plural air holding chambers and, as such, the illustrated embodiment is not intended to be limiting.

Surrounding some or all of the periphery of the center air chamber 18 of the heal chamber absorber member 17 is the peripheral decompression chamber 20. As illustrated in FIG. 1, the peripheral decompression chamber 20 is placed into fluid communication with a plastic tube, air conduit 22. To this end, the peripheral decompression chamber 20 may be provided with extensions 24 over which or into which the air conduit 22 is placed. In this manner, during use of the shoe, compression of the peripheral decompression chamber 20 by the heal of a wearer will cause air to be forced from the air chamber 20*a* of the peripheral decompression chamber 20 into the air conduit 22 where the air may then be vented through one or more vent holes 26 provided to the air conduit 22. Upon decompression of the peripheral decompression chamber 20, i.e., upon the force of the user's heel being removed from the heal chamber absorber member 17, air will be sucked back into the peripheral decompression chamber 20 via the vent holes 26 and air conduit 22. Again, the walls of the peripheral decompression chamber 20 are provided with a thickness that allows the peripheral decompression chamber 20 to deform and compress the air trapped therein while preventing, in cooperation with the air flow capabilities of the air conduit 22 and vent holes 26, any rupturing of the peripheral decompression chamber 20 during use of the shoe. An exemplary thickness is at least 1 mm. While illustrated in the form of a single air holding chamber 20*a* formed around the entire periphery of the center air chamber 18, it is to be appreciated that the peripheral decompression chamber 20 can include plural air holding chambers, can be disposed adjacent to the sides of the center air chamber 18, etc. Similarly, while a single air conduit 22 is illustrated, it will be appreciated that plural air conduits may be utilized. Accordingly, it will again be appreciated that the embodiments illustrated are not intended to be limiting.

As further illustrated in FIG. 1, the outsole/midsole unit 14 may be provided with a cavity 28 into which the heel chamber absorber member 17 may be placed. Similarly, the air conduit 22 may be positioned in grooves 30 formed in the out/sole midsole unit 14. Disposed over the air cushioning system 10 may then be positioned a lasting board 32. While not required, the lasting board 32 may be provided with an opening 34 that will allow the heal chamber absorber member 17 to be exposed to the interior of the upper 16 to thereby allow the heal of the user to interact with the heal chamber absorber member 17 during usage of the shoe, i.e., to compress the heal chamber absorber member 17 against the bottom wall of the cavity 28. Additionally, while not required, the lasting board 32 may be provided with an opening 36 that exposes the air vents 24 to the interior of the upper 16.

Figure 2:
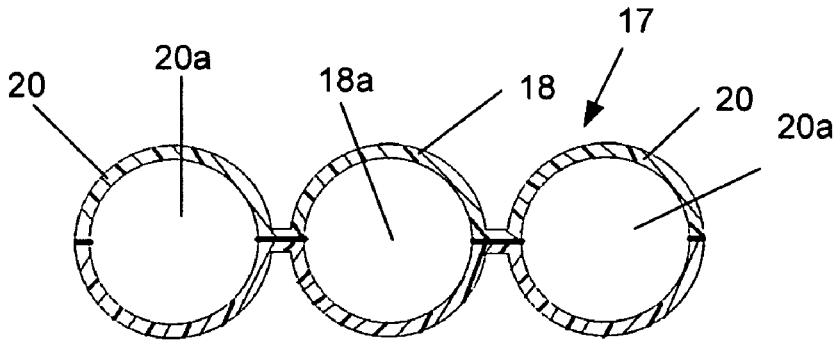
FIG. 2 is a cross-sectional view of exemplary air cushioning chambers that may be used in the exemplary air cushioning system of FIG. 1.

While specific examples of an air cushioning system have been described in detail, it will be appreciated by those skilled in the art that various modifications and alternatives to those details could be developed in light of the overall teachings of this disclosure. By way of example only, the chambers of the heel chamber absorber member 17 need not be provided with the generally rectangular cross-sections as illustrated in FIG. 1 but may provided with any suitable shape, such as the generally circular cross-sections illustrated in FIG. 2. Accordingly, the particular arrangements disclosed are meant to be illustrative only and not limiting as to the scope of the invention which is to be given the full breadth of the appended claims and any equivalents thereof.

What is claimed is:

1. An air cushioning, system for use in a shoe, comprising:
- a molded heel absorber member comprised of a center member having a periphery and a top surface that forms a sealed center air chamber and a peripheral member that extends about at least a portion of the periphery of the center member without covering any portion of the top surface of the center member and that forms a vented peripheral air chamber; and
- a vented air conduit in communication with the vented peripheral air chamber.

2. The air cushioning system as recited in claim 1, wherein the vented air conduit comprises plural venting holes.

3. The air cushioning system as recited in claim 1, wherein the vented air conduit member comprises a single tube that is in communication with the vented peripheral air chamber at opposed sides of the molded heel absorber member.

4. The air cushioning system as recited in claim 1, wherein the peripheral member extends about the entire periphery of the center member.

5. The air cushioning system as recited in claim 1, wherein the peripheral member and the center member have generally rectangular cross-sections.

6. The air cushioning system as recited in claim 1, wherein the peripheral member and the center member have generally circular cross-sections.

7. The air cushioning system as recited in claim 1, wherein the peripheral member, forms a single vented peripheral air chamber.

8. The air cushioning system as recited in claim 1, wherein the center member forms a single sealed center air chamber.

9. The air cushioning system as recited in claim 1, wherein the molded heel absorber member comprises an upper molded member and a lower molded member heat sealed along their respective edges.

10. A shoe, comprising:
- an outsole/midsole unit;
- an upper attached to the outsole midsole unit; and
- an air cushioning system disposed in the outsole/midsole unit comprised of:
  - a molded heel absorber member comprised of a center member having a periphery and a top surface that forms a sealed center air chamber and a peripheral member that extends about at least a portion of the periphery of the center member without covering any portion of the top surface of the center member and that forms a vented peripheral air chamber; and
  - a vented air conduit in communication with the vented peripheral air chamber.

11. The shoe as recited in claim 10, wherein the vented air conduit comprises plural venting holes.

12. The shoe as recited in claim 10, wherein the vented air conduit member comprises a single tube that is in communication with the vented peripheral air chamber at opposed side of the molded heel absorber member.

13. The shoe as recited in claim 10, wherein the peripheral member extends about the entire periphery of the center member.

14. The shoe as recited in claim 10, wherein the peripheral member and the center member have, generally rectangular cross-sections.

15. The shoe as recited in claim 10, wherein the peripheral member and the center member have generally circular cross-sections.

16. The shoe as recited in claim 10, wherein the peripheral member forms a single vented peripheral air chamber.

17. The shoe as recited in claim 10, wherein the center member forms a single sealed center air chamber.

18. The shoe as recited in claim 10, wherein the molded heel absorber member comprises an upper molded member and a lower molded member heat sealed along their respective edges.

19. The shoe as recited in claim 10, wherein the outsole/midsole unit comprises a chamber in a heel portion thereof in which is disposed the molded heel absorber member and a groove in a midsole region thereof in which is disposed the vented air conduit.

20. The shoe as recited in claim 19, comprising a lasting board disposed over at least a portion of the vented air conduit.

21. The shoe as recited in claim 20, wherein the lasting board has an opening over at least the molded heel absorber member.

22. The shoe as recited in claim 21, wherein the lasting board has a second opening over at least vents provided to the vented air conduit.

* * * * *